US008618512B2

(12) United States Patent
Jagannathan et al.

(10) Patent No.: US 8,618,512 B2
(45) Date of Patent: Dec. 31, 2013

(54) STORAGE PHOSPHOR PANEL WITH OVERCOAT COMPRISING DYE

(75) Inventors: Seshadri Jagannathan, Rochester, NY (US); Marcus S. Bermel, Pittsford, NY (US); Daniel M. Leusch, Rochester, NY (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 13/170,648

(22) Filed: Jun. 28, 2011

(65) Prior Publication Data

US 2013/0001437 A1 Jan. 3, 2013

(51) Int. Cl.
*H05B 33/00* (2006.01)

(52) U.S. Cl.
USPC ..... 250/484.4

(58) Field of Classification Search
USPC ..... 250/484.4
See application file for complete search history.

(56) References Cited

U.S. PATENT DOCUMENTS

| | | | | |
|---|---|---|---|---|
| 4,380,702 | A | 4/1983 | Takahashi et al. | |
| 4,505,989 | A | 3/1985 | Umemoto et al. | |
| 4,696,868 | A * | 9/1987 | Aoki et al. | 428/690 |
| 4,879,202 | A * | 11/1989 | Hosoi et al. | 403/139 |
| 4,926,047 | A | 5/1990 | Takahashi et al. | |
| 4,950,559 | A * | 8/1990 | Arakawa et al. | 428/690 |
| 5,077,144 | A | 12/1991 | Takahashi et al. | |
| 5,401,971 | A | 3/1995 | Roberts | |
| 5,427,868 | A | 6/1995 | Bringley et al. | |
| 5,464,568 | A | 11/1995 | Bringley et al. | |
| 5,507,976 | A | 4/1996 | Bringley et al. | |
| 5,523,558 | A | 6/1996 | Bringley et al. | |
| 5,549,843 | A | 8/1996 | Smith et al. | |
| 5,639,400 | A | 6/1997 | Roberts et al. | |
| 6,652,994 | B2 | 11/2003 | Yanagita et al. | |

FOREIGN PATENT DOCUMENTS

| | | |
|---|---|---|
| CA | 1 346 300 | 12/1988 |

OTHER PUBLICATIONS

Xiaohui Wang; Richard L. Van Metter; David H. Foos; and David J. Steklenski in *Comprehensive and Automated Image Quality Performance Measurement of Computed Radiography Systems* (*Proceedings Paper*), SPIE Proceedings vol. 4320, Medical Imaging 2001: Physics of Medical Imaging, pp. 308-315 (Jun. 2001).

* cited by examiner

*Primary Examiner* — Kiho Kim

(57) ABSTRACT

A storage phosphor screen including a substrate; a phosphor layer disposed over the substrate; and an overcoat layer disposed over the phosphor layer, wherein the overcoat layer comprises at least one organic solvent-soluble polymer and at least one light absorbing colorant, and wherein the light absorbing colorant is dispersed within the organic solvent-soluble polymer. Also disclosed is a method of preparing a storage phosphor screen including providing a substrate; providing a phosphor solution comprising a solvent, at least one stimulable phosphor, and a binder; providing an overcoat solution comprising a solvent, at least one organic solvent-soluble polymer and at least one light absorbing colorant; forming a phosphor layer over a surface of the substrate with the phosphor solution; and forming an overcoat layer over the phosphor layer with the overcoat solution, wherein the light absorbing colorant is dispersed within the overcoat layer.

11 Claims, 3 Drawing Sheets

STORAGE PHOSPHOR PANEL WITH OVERCOAT COMPRISING DYE

FIELD OF THE DISCLOSURE

This disclosure relates generally to storage phosphor panels, and in particular to storage phosphor panels having an overcoat comprising dye therein. This disclosure also relates to a method of making these storage phosphor panels.

BACKGROUND OF THE DISCLOSURE

Near the beginning of the $20^{th}$ century, it was recognized that a medically useful anatomical image could be obtained when a film containing a radiation-sensitive silver halide emulsion is exposed to X-radiation (X-rays) passing through the patient. Subsequently, it was recognized that X-ray exposure could be decreased considerably by placing a radiographic phosphor panel adjacent to the film.

A radiographic phosphor panel typically contains a layer of an inorganic phosphor that can absorb X-rays and emit light to expose the film. The inorganic phosphor layer is generally a crystalline material that responds to X-rays in an image-wise fashion. Radiographic phosphor panels can be classified, based on the type of phosphors used, as prompt emission panels and image storage panels.

Image storage panels (also commonly referred to as "storage phosphor panels") typically contain a storage ("stimulable") phosphor capable of absorbing X-rays and storing its energy until subsequently stimulated to emit light in an image-wise fashion as a function of the stored X-ray pattern. A well-known use for storage phosphor panels is in computed or digital radiography. In these applications, the panel is first image-wise exposed to X-rays, which are absorbed by the inorganic phosphor particles, to create a latent image. While the phosphor particles may fluoresce to some degree, most of the absorbed X-rays are stored therein. At some interval after initial X-ray exposure, the storage phosphor panel is subjected to longer wave length radiation, such as visible or infrared light (e.g., stimulating light), resulting in the emission of the energy stored in the phosphor particles as stimulated luminescence (e.g, stimulated light) that is detected and converted into sequential electrical signals which are processed in order to render a visible image on recording materials, such as light-sensitive films or digital display devices (e.g., television or computer monitors). For example, a storage phosphor panel can be image-wise exposed to X-rays and subsequently stimulated by a laser having a red light or infrared beam, resulting in green or blue light emission that is detected and converted to electrical signals which are processed to render a visible image on a computer monitor. Thereafter, images from storage phosphor panels can be "erased" by exposure to UV radiation, such as from fluorescent lamps.

Thus, storage phosphor panels are typically expected to store as much incident X-rays as possible while emitting stored energy in a negligible amount until after subsequent stimulation; only after being subjected to stimulating light should the stored energy be released. In this way, storage phosphor panels can be repeatedly used to store and transmit radiation images.

By the same token, because storage phosphor panels can be repeatedly used, it is important to protect the phosphor layer from mechanical and environmental damage. Degradation of final images in storage phosphor panels from environmental factors (e.g., humidity, oxygen exposure, liquid exposure, etc.) or for mechanical reasons (e.g., abrasion, jamming, wear and tear, etc.) have been concerns for many years. This is particularly important, for example, in radiographic phosphor panels that are transported in scanning modules and/or handled without protective encasings.

A thick polymeric overcoat layer is typically applied over the phosphor layer to provide adequate protection against mechanical and environmental damage. However, the thickness of the overcoat layer can negatively impact the resolution of the storage phosphor panel. As the thickness of the overcoat layer increases, the amount of stimulating light that is diffused or scattered also increases. Light spreads out as it diffuses, resulting in a loss of spatial resolution and contrast in the resultant image. Thus, the thicker the overcoat layer, the more light diffusion and the lower the resolution. To improve resolution and contrast, thinner overcoats could be employed; however, adequate protection still needs to remain a priority.

Prior solutions to these application problems have been proposed, such as U.S. Pat. No. 6,652,994, which is hereby incorporated by reference in its entirety. This solution involves a complex structure consisting of five layers—a support, a light absorbing layer, a phosphor layer, a reflective layer, and a protective layer. The high number of layers not only increases materials and production costs but also requires a thicker support to sustain the numerous layers above. Moreover, in general, the thinner a phosphor panel at a given amount of X-ray absorption, the better the image quality will be. Consequently, overall thicker panels (e.g., having five or more layers) will usually have poorer image quality as compared to overall thinner panels.

While such structures may have achieved certain degrees of success in their particular applications, there is a need to provide, in a cost-friendly manner, thinner storage phosphor panels having adequately protective overcoat layers with minimal sensitivity to light diffusion.

SUMMARY OF THE INVENTION

In an aspect, there is provided a storage phosphor screen including a substrate; a phosphor layer disposed over the substrate; and an overcoat layer disposed over the phosphor layer, wherein the overcoat layer comprises at least one organic solvent-soluble polymer and at least one light absorbing colorant, and wherein the light absorbing colorant is dispersed within the organic solvent-soluble polymer.

In another aspect, there is also disclosed a method of preparing a storage phosphor screen including providing a substrate; providing a phosphor solution comprising a solvent, at least one stimulable phosphor, and a binder; providing an overcoat solution comprising a solvent, at least one organic solvent-soluble polymer and at least one light absorbing colorant; forming a phosphor layer over a surface of the substrate with the phosphor solution; and forming an overcoat layer over the phosphor layer with the overcoat solution, wherein the light absorbing colorant is dispersed within the overcoat layer.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

BRIEF DESCRIPTION OF THE DRAWINGS

The foregoing and other objects, features, and advantages of the invention will be apparent from the following more particular description of the embodiments of the invention, as illustrated in the accompanying drawings which are incorporated in and constitute a part of this specification. It should be noted that elements of the drawings are not necessarily to scale relative to each other as some details of the figures have been simplified and are drawn to facilitate understanding of the embodiments rather than to maintain strict structural accuracy, detail, and scale.

DETAILED DESCRIPTION OF THE INVENTION

Figure 1:
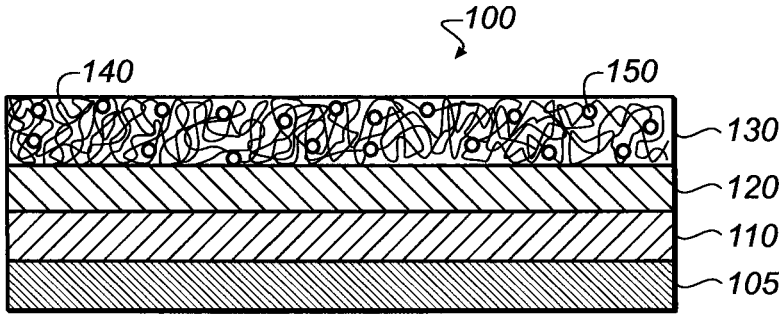
FIG. 1 depicts an exemplary portion of a storage phosphor panel in accordance with various embodiments of the present disclosure.

The following is a detailed description of the preferred embodiments of the invention, reference being made to the drawings in which the same reference numerals identify the same elements of structure in each of the several figures.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

Exemplary embodiments herein provide storage phosphor panels including an overcoat layer with dye, and methods of preparing thereof. In embodiments, the dye in the overcoat layer can absorb wavelengths of electromagnetic radiation (e.g., light) in the wavelength region of stimulating light.

FIG. 1 depicts a portion of an exemplary storage phosphor panel 100 in accordance with various embodiments of the present disclosure. As used herein, "storage phosphor panel" is understood to have its ordinary meaning in the art unless otherwise specified, and refers to phosphor panels or screens that can "store" X-radiation (X-rays) for emission at a later time when the screen is irradiated ("stimulated") with other radiation (usually with visible or infrared "stimulating light"). It should be readily apparent to one of ordinary skill in the art that the storage phosphor panel 100 depicted in FIG. 1 represents a generalized schematic illustration and that other components can be added or existing components can be removed or modified.

Storage phosphor panels disclosed herein can take any convenient form provided they meet all of the usual requirements for use in computed or digital radiography. Examples of construction, composition, methods of preparation, and use thereof, are described, for example, in U.S. Pat. Nos. 4,380,702; 4,926,047; 5,077,144; 5,401,971; 5,427,868; 5,464,568; 5,507,976; 5,523,558; 5,639,400; and Canadian Patent No. 1,246,300, the disclosures of which are incorporated herein by reference in their entirety.

As shown in FIG. 1, the storage phosphor panel 100 can include a substrate 110, a phosphor layer 120 disposed over the substrate, and an overcoat layer 130 disposed over the phosphor layer 120. Any flexible or rigid material suitable for use in storage phosphor panels can be used as the substrate 110, such as glass, plastic films, ceramics, polymeric materials, polymeric materials disposed on or laminated to a rigid metal sheet such as copper or aluminum, and combinations thereof. In certain embodiments, the substrate 110 can be made of flexible plastic or thermoplastic materials. The substrate 110 can include, for example, cellulose nitrates, cellulose esters, cellulose acetates (e.g., cellulose triacetates, cellulose diacetates, and the like), homo- and copolymers of olefins (e.g., polyethylenes and polypropylenes, and the like), homo- and copolymers of vinyl chloride (e.g., polyvinyl chloride and the like), homo- and copolymers of vinyl acetate (e.g., polyvinyl acetate and the like), polyesters of dibasic aromatic carboxylic acids with divalent alcohols (e.g., polyethylene terephthalalates, polyethylene napththalates, and the like), polyamides, polyimides, polycarbonates, polyesters, polystyrenes, and the like, and combinations thereof. Preferred thermoplastics include cellulose acetates, polyesters, polyethyelene terephthalalates, polyetheylene naphthalates, polyamides, polyimides, triacetates, polycarbonates, silicates, and combinations thereof.

In an aspect, black absorbing materials can be incorporated into or coated onto the substrate 110 as an anti-halation layer 105 to enhance radiation absorption. For example, in an embodiment, black absorbing materials comprising black dyes or carbon black and a suitable binder can be incorporated directly into the substrate 110 materials. Alternatively, black absorbing materials comprising black dyes or carbon black and a suitable binder can be applied on the backside of the substrate 110 as an anti-halation layer 105—e.g., on the opposite side of the substrate 110 comprising the phosphor layer 120 and further away from the X-ray source than the phosphor layer 120. Air can be trapped in the substrate 110 to reflect UV and visible radiation. If desired, adhesion-promoting subbing layers can be employed to help the phosphor layer 120 properly adhere to the substrate 110. In aspects, the adhesion-promoting subbing layers are not tinted and do not comprise a colorant. In an embodiment, the adhesion-promoting subbing layers are devoid of a colorant except for trace amounts due to contamination. If desired, a suitable anti-curl layer can be disposed on the backside of the substrate 110—e.g., above or below the anti-halation layer on the side of the substrate 110 opposite the phosphor layer 120. The anti-curl layer can optionally comprise black absorbing materials comprising black dyes, carbon black, and combinations thereof, dispersed within a polycarbonate binder; a lubricant, such as a micronized wax; and/or matte particles, such as organic polymer beads or inorganic particles.

In an embodiment, a light-reflecting layer or light-absorbing layer is not incorporated or disposed between the substrate 110 and the phosphor layer 120. For example, a light-reflecting layer comprising white pigment particles, such as titanium dioxide or barium sulfate, or a light-absorbing layer comprising a colorant such as colored dyes and pigments, including carbon black, to absorb stimulating light, is not incorporated or disposed between the substrate 110 and the phosphor layer 120.

The thickness of the substrate 110 can vary depending on the materials used so long as it is capable of supporting itself and layers disposed thereupon. Generally, the support can have a thickness ranging from about 50 μm to about 1,000 μm, for example from about 80 μm to about 1000 μm, such as from about 80 μm to about 500 μm. The substrate 110 can have a smooth and/or matte surface to promote adhesion with the phosphor layer 120.

The phosphor layer 120 can be disposed over the substrate 110. The phosphor layer 120 can include stimulable phosphor particles and a binder. As used herein, "storage phosphor particles" and "stimulable phosphor particles" are used interchangeably and are understood to have the ordinary meaning as understood by those skilled in the art unless otherwise specified. "Storage phosphor particles" or "stimulable phosphor particles" refer to phosphor crystals capable of absorbing and storing X-rays and emitting electromagnetic radiation (e.g., light) of a second wavelength when exposed to or stimulated by radiation of still another wavelength. Generally, stimulable phosphor particles are opaque polycrystals having particle diameters of several micrometers to several hundreds of micrometers; however, fine phosphor particles of submicron to nano sizes have also been synthesized and can be useful. It is generally appreciated that sharper images can be realized with smaller mean particle sizes; however, light emission efficacy declines with decreasing particle size. Thus, the optimum mean particle size for a given application is a reflection of the balance between imaging speed and desired image sharpness.

Stimulable phosphor particles can be obtained by doping, for example, rare earth ions as an activator into a parent material such as oxides, nitrides, oxynitrides, sulfides, oxysulfides, silicates, halides, and the like, and combinations thereof. As used herein, "rare earth" refers to chemical elements having an atomic number of 39 or 57 through 71 (also known as "lanthanoids"). Stimulable phosphor particles are capable of absorbing a wide range of electromagnetic radiation. In preferred embodiments, stimulable phosphor particles can absorb radiation having a wavelength of from about 0.01 to about 10 nm (e.g., X-rays) and from about 300 nm to about 400 μm (e.g., UV, visible, and infrared light). When stimulated with stimulating light having a wavelength in the range of visible and infrared light, stimulable phosphor particles can emit stimulated light at a wavelength of from about 300 nm to about 650 nm, preferably from about 350 nm to about 450 nm.

Suitable exemplary stimulable phosphor particles for use herein include, but are not limited to, compounds having Formula (I):

$$MFX_{1-z}I_zuM^aX^a{:}yA{:}eQ{:}tD \quad (I)$$

wherein M is selected from the group consisting of Mg, Ca, Sr, Ba, and combinations thereof;

X is selected from the group consisting Cl, Br, and combinations thereof;

$M^a$ is selected from the group consisting of Na, K, Rb, Cs, and combinations thereof;

$X^a$ is selected from the group consisting of F, Cl, Br, I, and combinations thereof;

A is selected from the group consisting of Eu, Ce, Sm, Th, Bi, and combinations thereof;

Q is selected from the group consisting of BeO, MgO, CaO, SrO, BaO, ZnO, $Al_2O_3$, $La_2O_3$, $In_2O_3$, $SiO_2$, $TiO_2$, $ZrO_2$, $GeO_2$, $Nb_2O_5$, $Ta_2O_5$, $ThO_2$, and combinations thereof;

D is selected from the group consisting of V, Cr, Mn, Fe, Co, Ni, and combinations thereof;

z is from about 0.0001 to about 1;

u is from about 0 to about 1;

y is from about 0.0001 to about 0.1;

e is from 0 to about 1; and t is from 0 to about 0.01.

The amounts represented by "z", "u", "y", "e", and "t" are molar amounts. The same designations appearing elsewhere in this disclosure have the same meanings unless otherwise specified. In Formula (I), preferably, M is Ba; X is Br; $M^a$ is selected from the group consisting of Na, K, and combinations thereof; $X^a$ is selected from the group consisting of F, Br, and combinations thereof; A is Eu; Q is selected from the group consisting of $SiO_2$, $Al_2O_3$, and combinations thereof; and t is 0.

Other exemplary stimulable phosphor particles for use herein include, but are not limited to, compounds having Formula (II):

$$(Ba_{1-a-b-c}Mg_aCa_bSR_c)FX_{1-z}I_zrM^aX^a{:}yA{:}eQ{:}tD \quad (II)$$

wherein X, $M^a$, $X^a$, A, Q, D e, t, z, and y are as defined above for Formula (I); the sum of a, b, and c, is from 0 to about 0.4; and r is from about $10^{-6}$ to about 0.1.

In Formula (II), preferably X is Br; $M^a$ is selected from the group consisting of Na, K, and combinations thereof; $X^a$ is selected from the group consisting of F, Br, and combinations thereof; A is selected from the group consisting of Eu, Ce, Bi, and combinations thereof; Q is selected from the group consisting of $SiO_2$, $Al_2O_3$, and combinations thereof; and t is 0.

Further exemplary stimulable phosphor particles for use herein include, but are not limited to, compounds having Formula (III):

$$M^{1+}X_aM^{2+}X'_2bM^{3+}X''3{:}cZ \quad (III)$$

wherein M is selected from the group consisting of Li, na, K, Cs, Rb, and combinations thereof;

$M^{2+}$ is selected from the group consisting of Be, Mg, Ca, Sr, Ba, Zn, Cd, Cu, Pb, Ni, and combinations thereof;

$M^{3+}$ is selected from the group consisting of Sc, Y, La, Ce, Pr, Nd, Pm, Sm, Eu, Gd, Tb, Dy Ho, Er, Tm Yb, Lum Al, Bi, In, Ga, and combinations thereof;

Z is selected from the group consisting of $Ga^{1+}$, $Ge^{2+}$, $Sn^{2+}$, $Sb^{3+}$, $As^{3+}$, and combinations thereof;

X, X' and X" can be the same or different and each individually represents a halogen atom selected from the group consisting of F, Br, Cl, I; and $0 \le a \le 1$; $0 \le b \le 1$; $0 < c \le 0.2$.

Preferred stimulable phosphor particles represented by Formulas (I), (II), or (III) include europium activated barium fluorobromides (e.g., BaFBr:Eu and BaFBrI:Eu), cerium activated alkaline earth metal halides, cerium activated oxyhalides, divalent europium activated alkaline earth metal fluorohalides, (e.g., $Ba(Sr)FBrEu^{2+}$) divalent europium activated alkaline earth metal halides, rare earth element activated rare earth oxyhalides, bismuth activated alkaline metal halide phosphors, and combinations thereof.

The phosphor layer 120 can further include one or more polymeric binders to provide structural adherence. Suitable binders can include a variety of organic polymers known for being transparent to X-rays, stimulating light, and stimulated light. Suitable exemplary binders include, but are not limited to, sodium o-sulfobenzaldehyde acetal of poly(vinyl alcohol), chlorosulfonated poly(ethylene), a mixture of macromolecular bisphenol poly(carbonates), cellulose acetate butyrate, styrene-butadiene copolymers, copolymers comprising bisphenol carbonates and poly(alkylene oxides), poly(alkyl acrylates), poly(alkyl methacrylates), alkyl acetates, copolymers of poly(alkyl acrylates) and poly(alkyl methacrylates) with acrylic and methacrylic acid, poly(vinyl butyrals), polyurethanes, gelatin, polysaccharides (e.g., dextran and gum arabic), poly(vinyl acetate), nitrocellulose, ethylcellulose, copolymers of vinylidene chloride and vinyl chloride, poly(vinyl alcohol), linear polyesters, and combinations thereof. Particularly useful binders include polyurethanes such as those commercially available under the trademarks ESTANE® (Goodrich Chemical) and PERMUTHANE® (Stahl International by). The binders used in the phosphor layer 120 can be the same or different as the organic solvent-soluble polymer 140 used in the overcoat layer 130. Alternatively, the phosphor layer 120 can include stimulable phosphor particles without a binder (binderless phosphor layer).

It is appreciated that thinner phosphor layers and sharper images can be realized when a high weight ratio of stimulable phosphor particles to binder is used. Generally, the weight ratio of stimulable phosphor particles to binder is at least 7:1, for example from about 7:1 to about 50:1, such as from about 10:1 to about 30:1. The dry thickness of the phosphor layer can range from about 10 μm to about 500 μm, preferably from about 25 μm to about 300 μm. The density of stimulable phosphor particles in the dry phosphor layer 120 can range from about 5 to about 5000 g/m$^2$, preferably from about 150 to about 1500 g/m$^2$, most preferably from about 300 to about 1000 g/m$^2$. In aspects, the phosphor layer 120 does not comprise a colorant (e.g., dye, pigment, carbon black, and the like) to absorb stimulating light or to reflect stimulated light. In an embodiment, the phosphor layer 120 is devoid of or essentially free of a colorant except for trace amounts due to contamination.

The overcoat layer 130 can be disposed over the phosphor layer 120. The overcoat layer 130 can include at least one organic solvent-soluble polymer 140 and at least one light absorbing colorant 150. Any organic solvent-soluble polymer suitable for use in storage phosphor panels can be used so long as it is soluble in an organic solvent and provides the desired mechanical strength and moisture resistance when dried. The organic solvent-soluble polymer 140 can be the same as the binder in the phosphor layer 120. Suitable exemplary organic solvent-soluble polymers include, but are not limited to, cellulose acetate, poly(methyl acrylate), poly (methyl methacrylate), poly(ethyl acrylate), poly(ethyl methacrylate), poly(chloromethyl methacrylate), poly(vinylidene fluoride-co-tetrafluoroethylene) "$PVF_2$", poly(vinyl alcohol), poly(ethylene), poly(carbonates), cellulose acetate butyrate, styrene-butadiene copolymers, copolymers comprising bisphenol carbonates and poly(alkylene oxides), poly (alkyl acrylates), poly(alkyl methacrylates) (e.g., poly(methyl methacrylate) and poly(ethyl methacrylate), alkyl acetates (e.g., ethyl acetate), copolymers of poly(alkyl acrylates) and poly(alkyl methacrylates) with acrylic and methacrylic acid, poly(vinyl butyrals), polyurethanes, poly(vinyl acetate), nitrocellulose, ethylcellulose, copolymers of vinylidene chloride and vinyl chloride, poly(vinyl alcohol), linear polyesters, and combinations thereof. Preferred organic solvent-soluble polymers include ethyl acetate, poly (methyl methacrylate) "PMMA" such as those commercially available under the trademark ELVACITE (ICI Acrylics of Memphis, Tenn.), poly(vinylidene fluoride-co-tetrafluoroethylene) "$PVF_2$" such as those commercially available under the trademark KYNAR (Atofina Chemicals, Inc. of Philadelphia, Pa.), and combinations thereof. In a preferred embodiment, the overcoat layer 130 includes $PVF_2$ and PMMA at a weight ratio of PMMA:$PVF_2$ ranging from about 10:90 to about 90:10.

The overcoat layer 130 can include at least one light absorbing colorant 150 evenly dispersed within the at least one organic solvent-soluble polymer 140 as seen in FIG. 1. The at least one light absorbing colorant 150 is not disposed as a layer between the phosphor layer 120 and the overcoat layer 130 or between the phosphor layer 120 and the substrate 110, nor is the light absorbing colorant 150 applied as a layer within a multilayer overcoat. As used herein "light absorbing colorant" refers to pigments or dyes that are capable of absorbing electromagnetic wavelengths, such as wavelengths within the spectrum of stimulating light. Suitable exemplary light absorbing colorants for use herein include, but are not limited to, ultramarine blue dye, cobalt blue dye, cerulean blue dye, chromium oxide, $TiO_2$—ZnO—CoO—NiO pigment, copper phthalocyanine, Methylene Blue ($C_{16}H_{18}ClN_3$), Azure B ($C_{16}H_{18}ClN_3S$), Toluidine Blue 0 ($C_{15}H_{16}N_3SCl$), Thionin ($C_{12}H_{10}ClN_3S$), Indocyanine Green (ICG), magnesium phthlalocyanine, oxatricarbocyanine, indotricarbocyanine, zinc phthalocyanine, oxazine, cryptocyanine, tetra-1-butyl-naphthalocyanine, and those commercially available under the trademark ZAPON FAST BLUE 3G (available from Hoechst AG), ESTROL BRILL BLUE N-3RL (available from Sumitomo Chemical Co., Ltd.), SUMIACRYL BLUE F-GSL (available from Sumitomo Chemical Co., Ltd.), D & C BLUE No. 1 (available from National Aniline Div. Allied Chemical & Dye Corp.), SPIRIT BLUE (available from Hodogaya Chemical Co., Ltd.), OIL BLUE No. 603 (available from Orient Chemical Industries, Ltd.), KITON BLUE A (available from Ciba-Geigy), AIZEN CATHILON BLUE GLH (available from Hodogaya Chemical Co., Ltd.), LAKE BLUE A, F, H (available from Kyowa Sangyo Co., Ltd.), RODALINE BLUE 6GX (available from Kyowa Sangyo Co., Ltd.), PRIMOCYANINE 6GX (available from Inabata & Co., Ltd.), BRILLACID GREEN 6BH (available from Hodogaya Chemical Co., Ltd.), CYANINE BLUE BNRS (available from Toyo Ink Mfg., Co., Ltd.), LIONOL BLUE SL (available from Toyo Ink Mfg., Co., Ltd.), and combinations thereof. Preferred light absorbing colorants include ultramarine blue dye. The light absorbing colorant 150 can be present in the overcoat layer 130 in an amount ranging from about 0.5% to about 25% by weight, for example from about 1% to about 10% by weight, relative to the total weight (dry weight) of the overcoat layer.

Without being limited by theory, it is believed that the light absorbing colorant 150 can absorb radiation within the spectrum of stimulating light, thereby reducing sensitivity to stimulating light diffusion or scattering due to overcoat thickness, and increasing the spatial resolution and contrast of the resultant image. In this way, finer control over storage phosphor panel construction can be afforded. For example, a thicker overcoat layer can be used, e.g., to increase protection against mechanical and environmental damage, without sacrificing image resolution and contrast. Additionally, by including a light absorbing colorant 150 in the overcoat layer 130 and not in the phosphor layer 120, a thinner phosphor layer 120 can be used, resulting in sharper images, while simultaneously decreasing sensitivity to stimulating light diffusion or scattering. Evenly dispersing a light absorbing colorant 150 within the organic solvent-soluble polymer 140 of the overcoat layer 130 (instead of including the colorant as a layer within a multilayer overcoat) can also decrease the overall thickness of the overcoat layer—as well as the overall thickness of the storage phosphor panel 100—resulting in a thinner storage phosphor panel 100 having excellent protection against mechanical and environmental damage while exhibiting superior image resolution.

The overcoat layer 130 can further include various optional materials, such as matte particles, lubricants, micronized waxes, surfactants, and the like, if desired. Useful matte particles include both inorganic and organic particles generally having a particle size of from about 4 μm to about 20 μm. Examples of suitable matte particles include, but are not limited to, talc, silica particles or other inorganic particulate materials, various organic polymeric particles known for this purpose in the art, and combinations thereof. Useful lubricants can be in solid or liquid form and include materials such as surface active agents, silicone oils, synthetic oils, polysiloxane-polyether copolymers, polyolefin-polyether block copolymers, fluorinated polymers, polyolefins, micronized waxes, and combinations thereof. Preferred lubricants include micronized waxes. The optional materials can be present in the overcoat layer 130 in an amount of from about 0.01% to about 10% by weight, relative to the total weight (dry weight) of the overcoat layer.

The overcoat layer 130 can have a (dry) thickness of from about 0.1 μm to about 50 μm, preferably from about 1 μm to about 25 μm, most preferably from about 3 μm to about 20 μm.

An exemplary method for preparing a storage phosphor panel 100 in accordance with various embodiments of the present teachings is provided below.

A substrate 110 can be provided as described above. Preferably, the substrate 110 comprises a thermoplastic, such as cellulose acetates, polyesters, polyethyelene terephthalalates, polyetheylene naphthalates, polyamides, polyimides, triacetates, polycarbonates, silicates, and combinations thereof; a black absorbing material, such as black dyes or carbon black; and a polycarbonate binder.

A phosphor solution can be provided comprising a solvent, at least one stimulable phosphor particle, and a binder. The stimulable phosphor particle can be any as described above. Preferably, the stimulable phosphor particle includes europium activated barium fluorobromides (e.g., BaFBr:Eu and BaFBrI:Eu), cerium activated alkaline earth metal halides, cerium activated oxyhalides, divalent europium activated alkaline earth metal fluorohalides, (e.g., Ba(Sr)FBrEu$^{2+}$) divalent europium activated alkaline earth metal halides, rare earth element activated rare earth oxyhalides, bismuth activated alkaline metal halide phosphors, and combinations thereof. Preferred binders include polyurethanes. The ratio of binder to stimulable phosphor particles (binder: phosphor) can range from about 1:1 to about 1:100, by weight, preferably from about 1:8 to about 1:50, by weight. The solvent can include any organic solvent known in the art for this purpose. Preferably, the solvent is a mixture of methylene chloride and methanol. The phosphor solution can be blended with any homogenizer known in the art for that purpose (e.g., a ball mill, sand mill, attritor, three-pole mill, high-speed impeller homogenizer, Kady mill, ultrasonic homogenizer, and the like) such that the stimulable phosphor particles are uniformly dispersed with the binder in the solvent.

An overcoat solution can be provided comprising a solvent, at least one organic solvent-soluble polymer, and at least one light absorbing colorant. The organic solvent-soluble polymer 140 and at least one light absorbing colorant 150 can be any as described above. Preferably, the organic solvent-soluble polymer 140 present in the overcoat solution includes ethyl acetate, $PVF_2$ and PMMA at a ratio of ethyl acetate: PMMA:$PVF_2$ ranging from about 10:90 to about 90:10 by weight. Preferably, the light absorbing colorant 150 includes ultramarine blue dye in an amount of from about 0.5% to about 25% by weight, more preferably from about 1% to about 10% by weight, relative to the total weight of the overcoat solution. The solvent can include any organic solvent known in the art for this purpose. Preferably, the solvent is a hydrophilic glycol ether, such as propylene glycol methyl ether, propylene glycol n-butyl ether, and mixtures thereof. The overcoat solution can be blended with any homogenizer known in the art for that purpose (e.g., a ball mill, sand mill, attritor, three-pole mill, high-speed impeller homogenizer, Kady mill, ultrasonic homogenizer, and the like) such that the light absorbing colorant 150 is uniformly dispersed with the organic solvent-soluble polymer 140 in the solvent.

The phosphor solution can be applied to a surface of the substrate 110 to form a phosphor layer 120. The phosphor solution can be applied using any conventional coating techniques known in the art for that purpose. For example, the phosphor solution can be applied onto a surface of the substrate 110 by spray coating, dip-coating, doctor blade coating, roll coating, knife coating, or slot die coating. An adhesion-promoting subbing layer, described above, can optionally be applied to the substrate 110 prior to application of the phosphor solution to promote adhesion of the phosphor layer 120. The solvent can be subsequently removed by evaporation, resulting in a phosphor layer 120. The edges of the phosphor layer 120 can optionally be beveled, such as to an angle ranging from about 30 to about 60 degrees. Suitable manufacturing techniques are described, for example, in U.S. Pat. No. 4,505,989, which is herein incorporated by reference in its entirety.

The overcoat solution can be applied over the phosphor layer 120 using any conventional coating techniques known in the art for that purpose. For example, the overcoat solution can be applied over the phosphor layer 120 by spray coating, dip-coating, doctor blade coating, roll coating, knife coating, or slot die coating. The solvent can be subsequently removed by evaporation, forming a protective overcoat layer 130 having the light absorbing colorant 150 dispersed evenly therein. The overcoat layer 130 can form a standard edge seal over the edges of the phosphor layer 120, for example over beveled edges.

EXAMPLES

Comparative Example 1

A phosphor solution was prepared by dispersing 61.9% by weight of a stimulable phosphor, such as those described in U.S. Pat. Nos. 5,523,558 and 5,549,843 (the disclosures of which are herein incorporated by reference in their entirety); 4.22% by weight of a polyurethane binder (Permuthane® U-6366); 1.24% by weight of barium thiosulfate; 0.0005% by weight of ($SiO_2$); and 0.000867% of tetrabutyl ammonium thiosulfate into 32.6% by weight of a 93:7 (ratio by weight) methylene chloride to methanol solvent system. The ratio of phosphor to binder was about 15:1 by weight.

An overcoat solution was prepared by blending 9.1% by weight of poly(methyl methacrylate) (PMMA) (Elvacite® 2051, available from Lucite International, Inc. of Cordova, Tenn.) and 3.9% of poly(vinylidene fluoride-co-tetrafluoroethylene) ($PVF_2$) (Kynar® 7201, available from Atochem North America of Philadelphia, Pa.) into 87% by weight ethyl acetate solvent. The ratio of PMMA to $PVF_2$ was about 7:3 by weight.

The phosphor solution was coated as a dispersion onto a flexible poly(ethylene phthalalate) substrate using a slot die coating method and subsequently dried to remove solvent. The density (total dry coverage) of the phosphor layer was about 850 g/m$^2$. The phosphor layer was about 300 μm thick. An anti-halation layer comprising carbon black and cellulose acetate binder was applied to the opposite side of the support at a density (total dry coverage) of about 50 g/m$^2$. After drying, the composite film of phosphor layer and polyester substrate was wound into rolls and immediately stored in a dry box with desiccant (less than 10% humidity) until it was used for testing.

The overcoat solution was applied onto the phosphor layer by knife blade coating and dried to a residual solvent level of less than 1% by weight of the final dry overcoat to form a storage phosphor panel. The overcoat formulation was applied to provide a density (total dry coverage) of about 18 g/m$^2$. The overcoat layer was about 17 μm thick.

The image quality of the storage phosphor panel including phosphor layer and overcoat layer was evaluated by examining its modulation transfer function (MTF). MTF is widely used in many imaging applications as a quantitative way of determining or measuring the resolution or sharpness of the imaging devices (e.g., the spatial resolution and X-ray detection ability). In computed or digital radiography, the MTF is dominantly decided by the storage phosphor panels used for X-ray absorption. Many well-established methods can be used for MTF measurement of a digital radiography system. Here, the Edge method as described by Xiaohui Wang; Richard L. Van Metter; David H. Foos; and David J. Steklenski in *Comprehensive and Automated Image Quality Performance Measurement of Computed Radiography Systems* (*Proceedings Paper*), SPIE Proceedings Vol. 4320, Medical Imaging 2001: Physics of Medical Imaging, pp. 308-315 (June 2001), was used.

Comparative Example 2

A phosphor solution was prepared by dispersing 68.4% by weight of a stimulable phosphor such as those described in U.S. Pat. Nos. 5,523,558 and 5,549,843 (the disclosures of which are herein incorporated by reference in their entirety); 1.96% by weight of a polyurethane binder (Permuthane® U-6366); 4.43% by weight of dioxolane; and 0.000867% of tetraethyl ammonium thiosulfate into 25.1% by weight of a 93:7 (ratio by weight) methylene chloride to methanol solvent system. The ratio of phosphor to binder was about 35:1 by weight. The stimulable phosphor was different than that used in Comparative Example 1.

An overcoat solution was prepared by blending 9.1% by weight of poly(methyl methacrylate) (PMMA) (Elvacite® 2051, available from Lucite International, Inc. of Cordova, Tenn.) and 3.9% of poly(vinylidene fluoride-co-tetrafluoroethylene) ($PVF_2$) (Kynar® 7201, available from Atochem North America of Philadelphia, Pa.) into 87% by weight ethyl acetate solvent. The ratio of PMMA to $PVF_2$ was about 7:3 by weight.

The phosphor solution was coated as a dispersion onto a flexible poly(ethylene phthalalate) substrate using a slot die coating method and subsequently dried to remove solvent. The density (total dry coverage) of the phosphor layer was about 425 g/m$^2$. The phosphor layer was about 150 μm thick. An anti-halation layer comprising carbon black and cellulose acetate binder was applied to the opposite side of the support at a density (total dry coverage) of about 25 g/m$^2$. After drying, the composite film of phosphor layer and polyester substrate was wound into rolls and immediately stored in a dry box with desiccant (less than 10% humidity) until it was used for testing.

The overcoat solution was applied onto the phosphor layer by knife blade coating and dried to a residual solvent level of less than 1% by weight of the final dry overcoat to form a storage phosphor panel. The overcoat formulation was applied to provide a density (total dry coverage) of about 6 g/m$^2$. The overcoat layer was about 6 μm thick.

The MTF of the storage phosphor panel including phosphor layer and overcoat layer was measured in the same way as Comparative Example 1.

Comparative Example 3

An overcoat solution was prepared by blending 9.1% by weight of poly(methyl methacrylate) (PMMA) (Elvacite® 2051, available from Lucite International, Inc. of Cordova, Tenn.), 3.9% of poly(vinylidene fluoride-co-tetrafluoroethylene) ($PVF_2$) (Kynar® 7201, available from Atochem North America of Philadelphia, Pa.), and 1% by weight (10000 ppm) of ultramarine blue dye (in 86% by weight ethyl acetate solvent) The ratio of PMMA to $PVF_2$ was about 3:1 by weight.

The same phosphor layer and support as Comparative Example 2 was used and the above described overcoat solution was coated onto the phosphor layer in the same way as Comparative Example 2 to form a storage phosphor panel. The overcoat formulation was applied to provide a density (total dry coverage) of about 45 g/m$^2$. The overcoat layer was about 10 μm thick. The resulting screen had blue hard spots throughout coating, and was unusable.

Comparative Example 4

An overcoat solution was prepared by blending 9.1% by weight of poly(methyl methacrylate) (PMMA) (Elvacite® 2051, available from Lucite International, Inc. of Cordova, Tenn.), 3.9% of poly(vinylidene fluoride-co-tetrafluoroethylene) ($PVF_2$) (Kynar® 7201, available from Atochem North America of Philadelphia, Pa.), and 14.29% by weight of ultramarine blue dye (in 81.25% by weight ethyl acetate solvent and 4.75% by weight glycol ether (Dowanol PM®) solvent). The ratio of PMMA to $PVF_2$ was about 7:3 by weight.

The same phosphor layer and support as Comparative Example 2 was used and the above described overcoat solution was coated onto the phosphor layer in the same way as Comparative Example 2 to form a storage phosphor panel. The overcoat formulation was applied to provide a density (total dry coverage) of about 45 g/m$^2$. The overcoat layer was about 10 μm thick. The resulting screen released blue dye from the overcoat upon touch, and was unusable.

Inventive Example 1

An overcoat solution was prepared by blending 9.1% by weight of poly(methyl methacrylate) (PMMA) (Elvacite® 2051, available from Lucite International, Inc. of Cordova, Tenn.), 3.9% of poly(vinylidene fluoride-co-tetrafluoroethylene) ($PVF_2$) (Kynar® 7201, available from Atochem North America of Philadelphia, Pa.), and 1% by weight (10000 ppm) of ultramarine blue dye (into 87% by weight ethyl acetate solvent and 4.75% by weight glycol ether (Dowanol PM®) solvent. The ratio of PMMA to $PVF_2$ was about 7:3 by weight.

The same phosphor layer and support as Comparative Example 1 was used and the above described overcoat solution was coated onto the phosphor layer in the same way as Comparative Example 1 to form a storage phosphor panel. The overcoat formulation was applied to provide a density (total dry coverage) of about 18 g/m$^2$. The overcoat layer was about 17 μm thick.

The MTF of the storage phosphor panel including phosphor layer and overcoat layer was measured in the same way as Comparative Example 1.

Inventive Example 2

An overcoat solution was prepared by blending 9.1% by weight of poly(methyl methacrylate) (PMMA) (Elvacite® 2051, available from Lucite International, Inc. of Cordova, Tenn.), 3.9% of poly(vinylidene fluoride-co-tetrafluoroethylene) ($PVF_2$) (Kynar® 7201, available from Atochem North America of Philadelphia, Pa.), and 1% by weight (10000 ppm) of ultramarine blue dye (into 87% by weight ethyl acetate solvent and 4.75% by weight glycol ether (Dowanol PM®) solvent. The ratio of PMMA to $PVF_2$ was about 7:3 by weight.

The same phosphor layer and support as Comparative Example 2 was used and the above described overcoat solution was coated onto the phosphor layer in the same way as Comparative Example 2 to form a storage phosphor panel. The overcoat formulation was applied to provide a density (total dry coverage) of about 6 g/m$^2$. The overcoat layer was about 6 μm thick.

The MTF of the storage phosphor panel including phosphor layer and overcoat layer was measured in the same way as Comparative Example 1.

Table 1 below, and corresponding FIG. 2, describes the measured MTFs of Comparative Example 1 and Inventive Example 1.

TABLE 1

| lp/mm | Comparative Example 1 (MTF) | Inventive Example 1 (MTF) |
|---|---|---|
| 0.0 | 100 | 100 |
| 0.5 | 80.7 | 88.6 |
| 1.0 | 55.5 | 69.4 |
| 1.5 | 36.9 | 54.1 |
| 2.0 | 25.3 | 42.5 |
| 2.5 | 18.1 | 33.2 |
| 3.0 | 13.3 | 26.0 |
| 3.5 | 10.2 | 21.4 |
| 4.0 | 8.3 | 19.1 |
| 4.5 | 7 | 17.9 |
| 5.0 | 5.8 | 17.2 |
| 5.5 | 5.4 | 17.2 |

Figure 2:
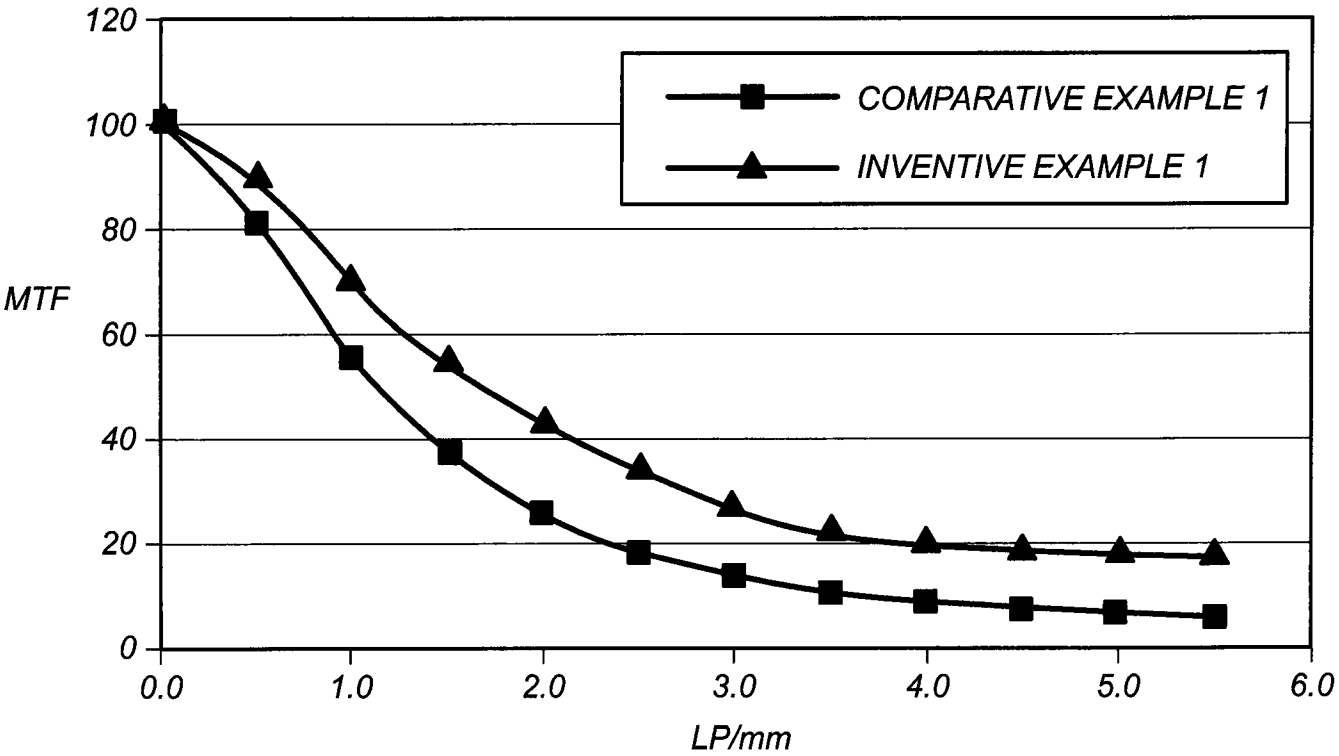
FIG. 2 compares the MTF performance of a storage phosphor panel in accordance with various embodiments of the present disclosure versus a comparative storage phosphor panel.

As shown in FIG. 2, the MTF of Inventive Example 1 (comprising at least one light absorbing colorant) was higher across all spatial frequencies (line pairs per millimeter (lp/mm)) than Comparative Example 1. A higher MTF indicates higher image detail. Thus, at the same spatial frequency, for example 1.0 lp/mm, Inventive Example 1 demonstrated an MTF of 69.4 whereas Comparative Example 1 demonstrated an MTF of only 55.5. Likewise, at 5.5 lp/mm, Inventive Example 1 demonstrated an MTF of 17.2 whereas Comparative Example 1 demonstrated an MTF of only 5.4.

Figure 3:
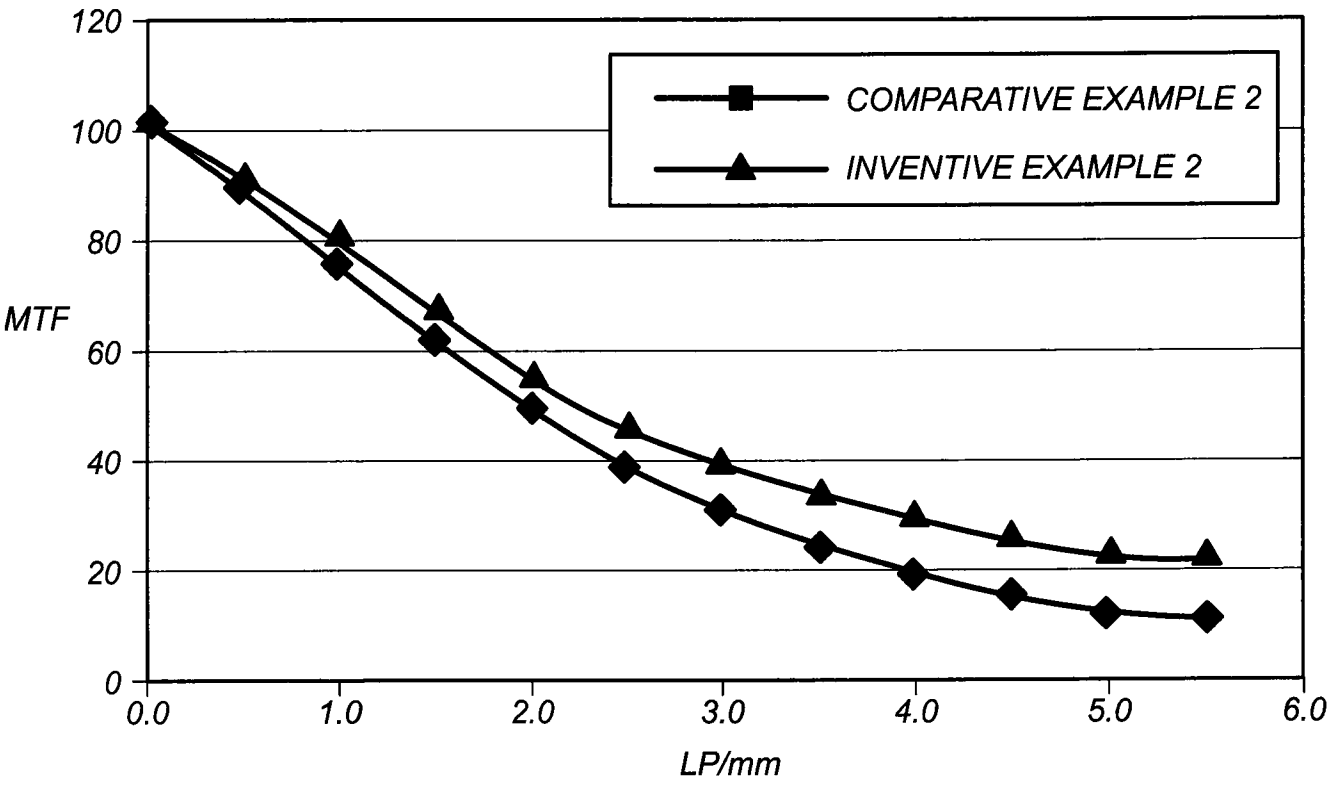
FIG. 3 compares the MTF performance of another storage phosphor panel in accordance with various embodiments of the present disclosure versus another comparative storage phosphor panel.

The same high image detail can be achieved even with a thinner phosphor layer than that used in FIG. 2. As shown in Table 2 below, and corresponding FIG. 3, the MTF of Inventive Example 2 (comprising at least one light absorbing colorant and with a 150 μm phosphor layer) was higher across all spatial frequencies (lp/mm) than Comparative Example 2. For example, at the same spatial frequency of 1.0 lp/mm, Inventive Example 2 demonstrated an MTF of 79.3 whereas Comparative Example 2 demonstrated an MTF of only 75.5. Likewise, at 5.5 lp/mm, Inventive Example 2 demonstrated an MTF of 21.2 whereas Comparative Example 2 demonstrated an MTF of only 11.3.

TABLE 2

| lp/mm | Comparative Example 2 (MTF) | Inventive Example 2 (MTF) |
|---|---|---|
| 0.0 | 100 | 100 |
| 0.5 | 88.8 | 91.0 |
| 1.0 | 75.5 | 79.3 |
| 1.5 | 61.7 | 66.3 |
| 2.0 | 49.1 | 54.5 |
| 2.5 | 38.6 | 45.1 |

TABLE 2-continued

| lp/mm | Comparative Example 2 (MTF) | Inventive Example 2 (MTF) |
|---|---|---|
| 3.0 | 30.3 | 38.2 |
| 3.5 | 23.9 | 33.1 |
| 4.0 | 19.0 | 29.0 |
| 4.5 | 15.1 | 25.5 |
| 5.0 | 12.1 | 22.2 |
| 5.5 | 11.3 | 21.2 |

The above results readily demonstrate that a storage phosphor panel comprising an overcoat with at least one light absorbing colorant as described herein effectively increases image resolution across a number of phosphor layer thicknesses and with different stimulable phosphors. Furthermore, the overcoat described herein provides clear advantage over prior overcoats without at least one light absorbing colorant therein.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method of preparing a storage phosphor screen, comprising:

providing a substrate;

providing a phosphor solution comprising a solvent, at least one stimulable phosphor, and a binder;

providing an overcoat solution comprising a solvent, at least one organic solvent-soluble polymer, and at least one light absorbing colorant;

forming a phosphor layer over a surface of the substrate with the phosphor solution; and forming an overcoat layer over the phosphor layer with the overcoat solution to form the storage phosphor screen, wherein the light absorbing colorant is dispersed within the overcoat layer, wherein the overcoat layer is at least 15 μm thick and does not reduce an MTF of the storage phosphor screen.

2. The method of claim 1, wherein the overcoat layer comprises a thickness ranging from about 15 μm to about 50 μm.

3. The method of claim 2, wherein the overcoat layer comprises a thickness ranging from about 15 μm to about 25 μm.

4. The method of claim 3, wherein the overcoat layer comprises a thickness of from about 15 μm to about 20 μm.

5. The method of claim 1, wherein the light absorbing colorant is present in the overcoat solution in an amount ranging from about 0.05% to about 10% by weight, relative to the total weight of the overcoat solution.

6. The method of claim 5, wherein the light absorbing colorant is present in the overcoat solution in an amount ranging from about 1% to about 5% by weight, relative to the total weight of the overcoat solution.

7. The method of claim 1, wherein the light absorbing colorant is selected from the group consisting of ultramarine blue dye, cobalt blue dye, cerulean blue dye, chromium oxide, TiO2-ZnO—CoO—NiO based pigments, and mixtures thereof.

8. The method of claim 1, wherein the phosphor layer comprises a thickness ranging from about 10 μm to about 500 μm.

9. The method of claim 1, wherein the phosphor solution does not comprise a colorant.

10. The method of claim 1, wherein the substrate is selected from the group consisting of glass, plastic films, ceramics, polymeric materials, polymeric materials disposed over a rigid metal sheet, and combinations thereof.

11. A method of preparing a storage phosphor screen, comprising:

providing a substrate;

providing a phosphor solution comprising a solvent, at least one stimulable phosphor, and a binder;

providing an overcoat solution comprising a solvent, at least one organic solvent-soluble polymer, and at least one light absorbing colorant;

forming a phosphor layer over a surface of the substrate with the phosphor solution; and forming an overcoat layer over the phosphor layer with the overcoat solution, wherein the light absorbing colorant is dispersed within the overcoat layer.

* * * * *